US006398329B1

(12) United States Patent
Boyd et al.

(10) Patent No.: US 6,398,329 B1
(45) Date of Patent: Jun. 4, 2002

(54) THERMAL INKJET PEN HAVING A BACKPRESSURE SENSOR

(75) Inventors: Melissa D. Boyd, Corvallis, OR (US); Timothy Beerling, Berkeley, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 2 days.

(21) Appl. No.: 09/712,699

(22) Filed: Nov. 13, 2000

(51) Int. Cl.[7] ..... B41J 2/195
(52) U.S. Cl. ..... 347/7
(58) Field of Search ..... 347/7, 1, 5, 6, 347/20, 84–100; 73/700, 708, 113

(56) References Cited

U.S. PATENT DOCUMENTS

| | | | |
|---|---|---|---|
| 4,835,435 | A | 5/1989 | Yeung et al. |
| 4,922,268 | A | 5/1990 | Osborne |
| 5,040,022 | A | 8/1991 | Pollacek et al. |
| 5,387,976 | A | 2/1995 | Lesniak |
| 5,788,388 | A | 8/1998 | Cowger et al. |

*Primary Examiner*—Raquel Yvette Gordon

(57) ABSTRACT

A backpressure sensor is integrated into a printhead die, or alternatively to a pen body. The backpressure sensor is susceptible to ink pressure from ink within a printhead ink slot, ink channel or nozzle chamber, and to ambient pressure. For the alternative embodiment, the backpressure sensor is susceptible to ink pressure from ink within an ink slot, ink channel or ink cavity away from a printhead die, and to ambient pressure.

23 Claims, 3 Drawing Sheets

FIG. 5
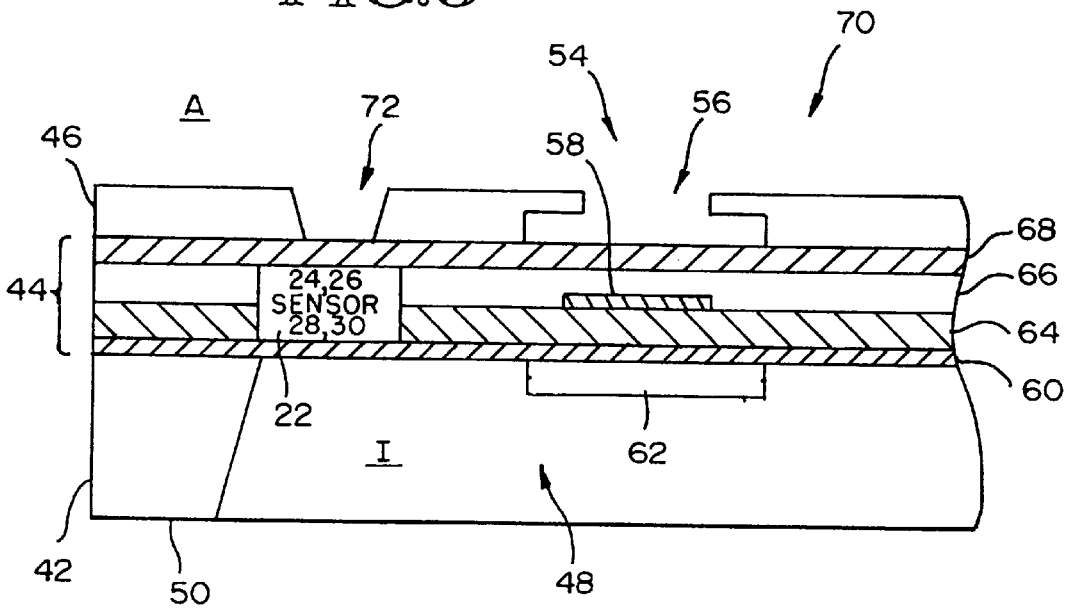
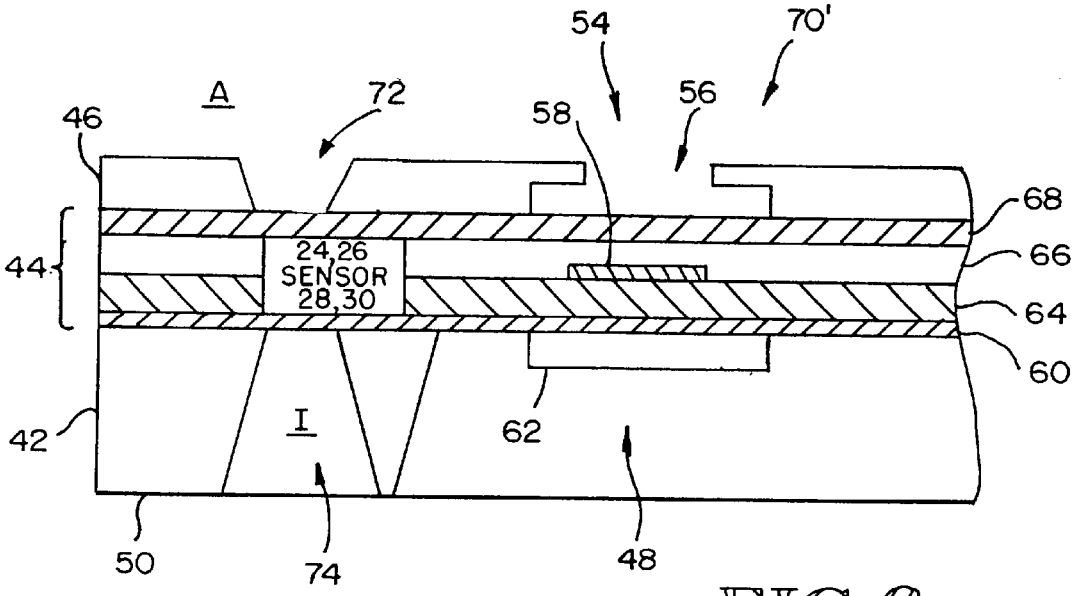
FIG. 6

THERMAL INKJET PEN HAVING A BACKPRESSURE SENSOR

BACKGROUND OF THE INVENTION

This invention relates generally to thermal inkjet pen construction, and more particularly to a thermal inkjet pen having a backpressure sensor.

The component within an inkjet printer that places ink onto a media sheet is referred to as an inkjet pen. The inkjet pen includes a printhead through which ink is ejected. The pen also includes ink channels for flowing ink from an ink supply to the printhead. For some pen types the ink supply is part of the pen and is stored in a local reservoir within the pen body. In other pen types, the pen may have an ink supply that continuously moves ink. For example, the pen may be a recirculating ink pen that continuously moves ink from the external ink supply into the pen then back to the ink supply. Alternatively the pen may receive ink into a local reservoir on the pen body from an external ink source.

The inkjet printhead includes one or more printhead dies and may be an elongated printhead, such as for a page-wide array printhead, or a short printhead. The printhead may be stationary as in a pagewide array design or scanned as in a short printhead. An elongated printhead less than a page width also may be scanned.

Each printhead die includes a number of nozzles through which ink drops are selectively expelled, and an ink feed slot. Some printhead dies also include an ink manifold (channels) coupling the nozzles to the ink slot. Each nozzle includes a nozzle chamber, a firing element, ink feed channels or openings, and a nozzle orifice.

Typically, ink flows from the ink feed slot through the ink feed channels into the nozzle chamber under capillary action. Specifically, the geometry of the chamber and channel allow ink to be drawn from the ink slot in response to a nozzle firing. The ejection of ink draws more ink into the chamber. Such capillary action counteracts the forces of backpressure. Backpressure is the partial vacuum within an inkjet feed slot or local reservoir that resists flow of ink through the printhead. Backpressure is considered in the positive sense so that an increase in backpressure represents an increase in partial vacuum. The backpressure at the printhead at all times is to be strong enough to prevent ink leakage. The backpressure, however, is not to be so strong as to prevent ink droplet ejection.

In a recirculating design, there are other effects in addition to the operational and ambient effects on backpressure. The recirculating flow rate, the pressure drop along the ink pathway, and the volume of ink (in systems including an accumulator) will all affect the backpressure. If the flow rate is too high, there will be a larger pressure drop along the ink pathway, and backpressure at the nozzles may change to an undesirable level. Specifically, it is undesirable for backpressure to increase to a pressure at which the nozzles deprime, or to decrease to the point at which ink leaks out the nozzles. In addition, the nozzles fire optimum droplets at a specific level of backpressure, and printing performance will degrade when backpressure is either too high or too low. Having knowledge of the exact backpressure at the nozzles allows the ink delivery system to adjust flow rate or ink volume to return the backpressure to acceptable levels.

A pen is primed by drawing ink into the nozzle chambers, creating a partial vacuum. This negative pressure, called backpressure, is required to keep ink from leaking out the nozzles. Capillary forces in the printhead nozzles counterbalance the backpressure in the ink, and allow the nozzles to remain full of ink. If backpressure becomes too high (too much vacuum), it will overcome the capillary forces in the nozzles and suck the ink back into the ink reservoir depriming the nozzles. The nozzles lose their ink and become unable to eject droplets. If the backpressure becomes too low (too little vacuum), the ink will spill uncontrollably out of the nozzles and the printhead will be unable to eject controlled droplets.

In prior inkjet printhead designs the backpressure was controlled using an accumulator or pressure regulator to be generally constant, while varying predictably during nozzle firing and nozzle chamber reloading. Foam also has been used to control backpressure forces.

SUMMARY OF THE INVENTION

According to the invention, an inkjet pen includes a backpressure sensor integrated into the pen. The pen includes a pen body and an inkjet printhead. The inkjet printhead includes one or more printhead dies. In a preferred embodiment the backpressure sensor is integrated into a printhead die. In an alternative embodiment the backpressure sensor is mounted, fastened or otherwise attached or integrated into the pen body.

According to an aspect of this invention, the backpressure sensor is susceptible to a pressure of ink and to ambient pressure providing an indication of the pressure differential, i.e., the backpressure. For the preferred embodiment the backpressure sensor is susceptible to ink pressure from ink within a printhead ink slot, ink channel or nozzle chamber, and to ambient pressure. For the alternative embodiment, the backpressure sensor is susceptible to ink pressure from ink within an ink slot, ink channel or ink cavity away from a printhead die, and to ambient pressure.

In a preferred embodiment, the backpressure sensor includes piezoresistive strain sensing elements able to respond to differential pressure variations of 0.1–10 inches of water.

According to an advantage of this invention, backpressure is monitored providing an indication of the operation of a printhead. This is beneficial for example in a pen having recirculating ink. The backpressure serves as a feedback for adjusting ink flow rate for a given work load of ink ejection. For example, when ink recirculation is increased to increase a cooling effect on the printhead, the pressure drop from pen inlet to outlet increases. If this pressure drop becomes too great, the pen may deprime or drool. Backpressure provides an indication that can be used to limit the flow rate.

These and other aspects and advantages of the invention will be better understood by reference to the following detailed description taken in conjunction with the accompanying drawings.

BRIEF DESCRIPTION OF THE DRAWINGS

FIG. 5 is a partial longitudinal section of a portion of the inkjet printhead die of FIG. 3 along line V—V according to an embodiment of this invention;

FIG. 6 is a partial longitudinal section of a portion of the inkjet printhead die of FIG. 3 along line V—V according to an alternative embodiment of this invention;

DESCRIPTION OF SPECIFIC EMBODIMENTS

Overview

Figure 1:
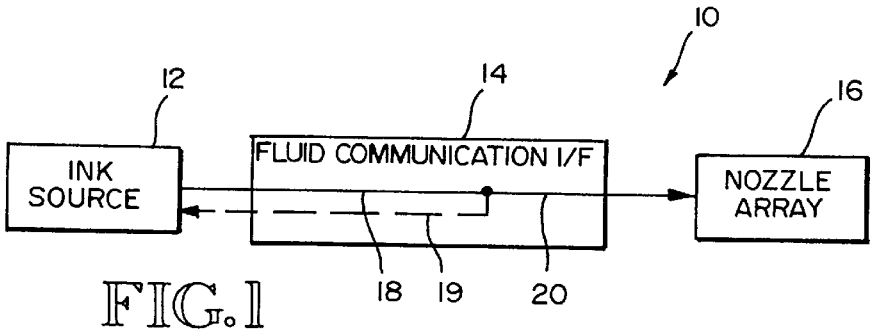
FIG. 1 is a block diagram of an inkjet printing apparatus.

FIG. 1 shows an inkjet printing apparatus 10, including an ink source 12, a fluid communication interface 14 and a nozzle array 16. In one embodiment the printing apparatus is formed by the pen component of an inkjet printer. An exemplary inkjet pen includes a pen body, a printhead and intervening structures that carry ink from an area within the pen to the printhead. In another embodiment the printing apparatus is formed by a pen along with an external ink source. In such other embodiment the pen may or may not have a local reservoir of ink. Even when an external source of ink is provided however, the pen typically includes intervening structures for carrying ink from the external source to the printhead. The nozzle array 16 is formed integral to the printhead.

Ink flows from the ink source 12 to the nozzle array 16 through the fluid communication interface 14. The ink source 12 is part of a pen and/or is an external ink source. The fluid communication interface 14 includes all the channel structures along which ink flows from the ink source 12 to get to the nozzle array 16. In some embodiments the fluid communication interface 12 includes a portion of the pen body, a portion of the inkjet printhead and any intervening structures. An exemplary intervening structure is an ink flow manifold.

In various embodiments the inkjet printing apparatus 10 is an active ink flow device or a passive ink flow device. For a passive ink flow device the ink flows from the ink source to the fluid communication interface, then into the inkjet nozzle array 16 along pathways 18 and 20. For an active ink flow device the ink flow is along a recirculating path 18, 19. Ink moves along the recirculating path 18, 19 to feed ink to the nozzle array at various feed channels 20 and continues back to the ink source 12 or a part thereof.

Ink flow along feed channels 20 typically is passive based on capillary action that draws ink into a nozzle in response to ejection of ink from the nozzle. To maintain such capillary action, the inkjet printing apparatus 10 is primed during manufacture to draw the ink along the channels 1&20 into nozzle chambers of respective nozzles. This priming creates a partial vacuum along the ink flow structures. The pressure of this partial vacuum that tends to draw ink back into the fluid channels from the nozzle chambers is referred to as backpressure. The geometry of the ink flow channels 20 and nozzle chambers, along with a pressure regulator device (e.g., an accumulator and/or a bubble generator) typically prevents the ink from being drawn back into the channel 20 or from leaking out of the nozzle.

According to an aspect of this invention, the backpressure is detected with a pressure sensor. The pressure sensor is mounted, fastened or otherwise attached or formed integral to the fluid communication interface or nozzle chamber. In various embodiments the pressure sensor is formed integral to the printhead for detecting a pressure differential between ambient pressure and pressure at any of (i) a nozzle chamber, (ii) an ink flow channel, (iii) an ink feed slot, (iv) a ink detection slot, or (v) an ink manifold. In other embodiments the pressure sensor is formed off of the inkjet printhead to detect the pressure differential between ambient pressure and pressure at a location within the fluid communication interface which is not part of the printhead (e.g., the pen body; a separate manifold; an ink channel; an ink slot). In the preferred embodiment the pressure sensor is formed integral to a printhead die. Following are descriptions of specific embodiments of the pressure sensor and the inkjet printing apparatus.

Pressure Sensor

The pressure sensor detects the backpressure by detecting a pressure differential between the ambient environment and an ink channel environment interior to the inkjet pen. One portion of the sensor is exposed to the external environment to be susceptible to the ambient environment. Another portion of the sensor is susceptible to the pressure within an ink slot or ink feed channel to be effected by the internal environment of the inkjet pen. In a preferred embodiment the pressure sensor is formed within a membrane with a plurality of sensor elements. In one embodiment a wheatstone bridge configuration of sensor elements are sandwiched between insulating layers forming the membrane. In a variation, two sensor elements are sandwiched between the insulating layers and two sensing elements are located away from (out of physical communication with) the membrane, and thus act as reference elements as the differential strain pressure does not affect them.

Figure 2:
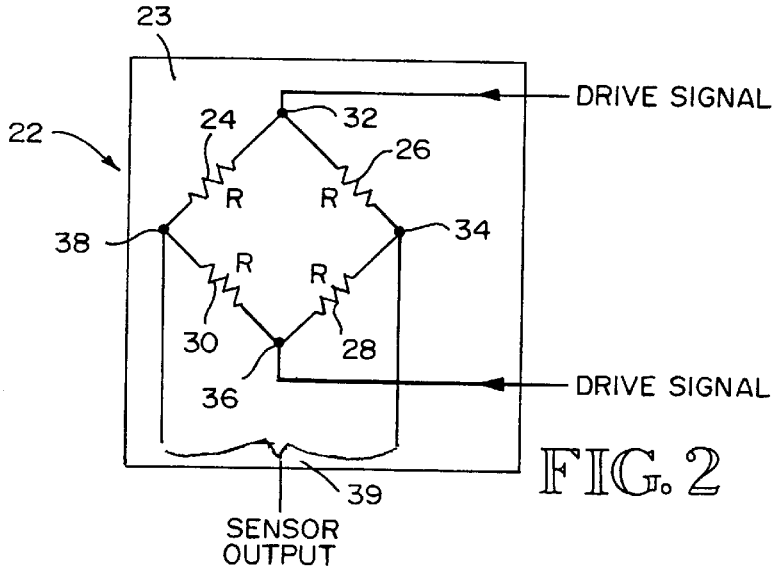
FIG. 2 is a schematic diagram of a backpressure sensor situated within the fluid communication interface of FIG. 1.

Referring to FIG. 2 a strain gauge pressure sensor 22 includes a membrane 23 and preferably four strain-sensing elements 24,26, 28 and 30. The sensor elements are linked serially and closed into a loop according to a conventional wheatstone bridge configuration as shown. The membrane 23 is exposed to both ambient pressure and the inkjet pen backpressure. Other portions of the membrane 23 are fixed relative to the inkjet pen, so that the membrane 23 preferably responds only to the pressure differential between the ambient environment pressure and the backpressure. The pressure differential causes the membrane 23 to deflect. The deflected membrane 23 causes a strain in all the sensor elements that are located on the membrane. The deflection of the membrane 23, due to the pressure differential, is thus sensed by the sensor elements. In a piezoresistive sensor element embodiment, the sensor elements respond to the deflection by changing their resistance. Such changed resistance changes the differential output signal 39 that is generated in response to a drive signal, preferably a direct current voltage source. There are four nodes 32, 34,36, and 38 in the wheatstone bridge configuration of FIG. 2. Node 32 receives the drive signal. Opposing node 36 receives the inverted drive signal. Alternatively stated, a drive signal voltage is applied across nodes 32 and 36. The differential output signal 39 (the sensor output) is read across nodes 34 and 38.

For micro device implementations such as an integrated sensor within an inkjet printhead, traditional capacitive strain sensing elements are likely to be too large in surface area, although use of capacitive stain sensing elements has been contemplated for some applications where size is not an issue. However, the use of piezoresistive strain gauge elements is preferred. For example, in a sensor 22 embodiment occupying approximately 10,000 square micrometers or less, the capacitive change due to pressure strain will be very small and difficult to detect. Conversely, when using piezoresistive elements, scaling to a small size does not result in corresponding difficulty in measuring resistive changes. When using piezoresistive elements, the gauge factor, 'GF', of the sensor 22 in terms of resistance and length is defined as:

$$GF = \frac{dR/R}{dL/L} = (1+2\nu) + \frac{d\rho/\rho}{\varepsilon_1}$$

where,

R is resistance;

L is length;

ν is a Poisson ratio;

ρ is resistivity; and $\epsilon_1$ is longitudinal strain

The first term (+2ν) takes into account stretching of the sensor membrane material. For example, a material with a non-zero Poisson's factor can have a non-zero gauge factor. The second factor $$\frac{d\rho/\rho}{\varepsilon_1},$$

takes piezoresistivity into account. For a strain sensor without piezoresistivity the gauge factor is usually around two. For piezoresistive materials, like silicon, the gauge factor can be over 100. Note that the gauge factor is not dependent on size. Thus, piezoresistive elements can be used independent of the scale of the elements, provided the membrane thickness is sealed properly to provide adequate compliance to a pressure differential.

The sensor output changes with changes in the resistance of the resistive elements. For perfectly matched resistors, the differential sensor output is preferably zero when no strain is present. For resistive elements that are not perfectly matched there may be a direct current offset voltage that can be easily removed or compensated for. In preferred embodiments the piezoresistive elements are preferably formed by using two p-type silicon piezoresistive elements and two n-type piezoresistive elements. The elements of the same type are situated diagonally opposite each other in the wheatstone bridge configuration. The n-type silicon piezoresistive elements respond to the membrane deflection with a change to the differential sensor output in one direction of polarity, while the p-type silicon piezoresistive elements respond to membrane deflection with a change to the differential sensor output in an opposite direction of polarity. In such an embodiment, strain on any of the four elements 24/26/28/30 can effect the differential sensor output. As preferably implemented, the membrane 23 deflects and accordingly varies the resistance of all sensor elements 24/26/28/30.

In an alternative embodiment the piezoresistive elements are formed by four of the same doping type of silicon piezoresistive elements (e.g., 4 n-type; or 4 p-type), in which two of the four are located on the membrane where deflection occurs, and the two of the four are located off the membrane or in a location on the membrane where deflection does not occur. In such embodiments the two elements on the membrane where deflection occurs have their resistance varied by the deflection of the membrane, while the resistance of the other two elements remains substantially unchanged due to the membrane deflection, and act as reference elements.

In another alternative embodiment the piezoresistive elements are formed by two of the same doping type (e.g., 2 n-type or 2 p-type) situated diagonally opposite in the wheatstone bridge and the two other elements in the wheatstone bridge are implemented to provide negligible or no contribution due to pressure strains (e.g., elements formed of metal or another low strain gauge material) to the differential sensor output. The elements with negligible or no contribution can be located anywhere on the membrane or even off the membrane. The two elements, which do contribute significantly to the differential sensor output, are located in the membrane area that deflects.

Inkjet Printhead Die with Integral Pressure Sensor

Figure 3:
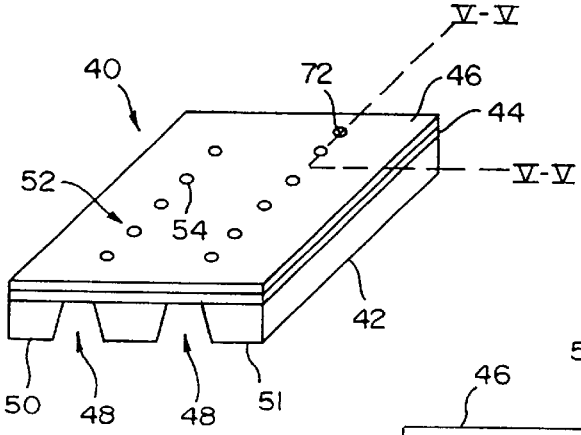
FIG. 3 is a perspective view of an inkjet printhead die.
Figure 4:
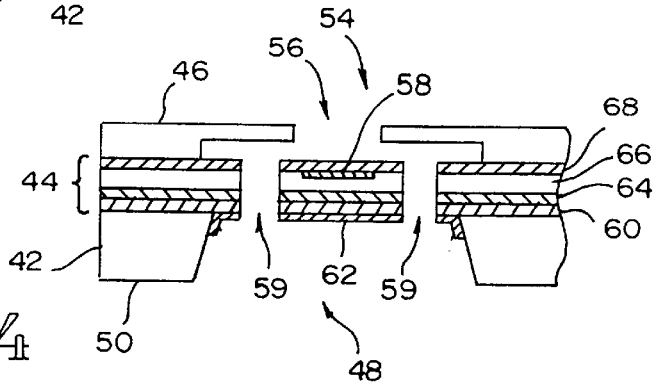
FIG. 4 is a diagram of the layers of an the inkjet printhead die of FIG. 3.

In various embodiments of the inkjet printing apparatus 10, an inkjet printhead having one or more printhead dies is included. Referring to FIGS. 3 and 4, a fully integrated thermal ('FIT') inkjet printhead die 40 includes a substrate 42, a thin film layer 44 and an orifice layer 46. One or more ink feed slots 48 are etched or otherwise formed along a surface 50 of the die 40. An array 52 of inkjet nozzles is formed in the printhead die. Each nozzle includes a nozzle chamber 56, a firing element 58, a nozzle orifice 54 and one or more ink feed channels 59. The thin film layer 44 is a stack of layers, including an insulating layer 60 (e.g., silicon dioxide), a thermally conductive layer 62 (e.g., titanium tungsten, aluminum, or tantalum), an insulating layer 64 (e.g., phosphosilicate glass—PSG), a dielectric layer 66 (e.g., silicon nitride, silicone carbide) and a protective passivation layer 68 (e.g., tantalum). The firing elements 58 are preferably integrated in the thin film layer 44 between the layers 64 and 68. In preferred embodiments, at least one pressure sensor 22 is integrated into a printhead die 40, which is accessible to ambient air through opening 72.

Referring to FIG. 5, one embodiment of a portion 70 of the inkjet printhead 40 is shown in a region of the pressure sensor 22. In this embodiment the pressure sensor is formed integral to the thin film layer 44 having at least the passivation layer 68 isolating the sensor from the ambient environment A. At least one insulating layer 60 isolates the strain sensitive elements from the ink. An opening 72 distinct from the nozzle opening 54 is preferably included in the orifice layer 46 to provide access for the pressure sensor to be exposed to ambient air pressure thus allowing the pressure to be subject to a differential pressure stress. For the sensor having 2 sensor elements and 2 reference elements, it is preferred that the strain sensing elements 24,28 (not shown in FIG. 5) are situated within the area of opening 72 so that such two elements 24,28 are susceptible to differential pressure strains. The other reference elements 26,30 (not shown in FIG. 5) are situated in an area of the within thin film layer 44 (sensor membrane 23) not susceptible to the differential pressure.

In other embodiments in which all sensor elements are of the same type or where 2 resistive elements are to give negligible response, two elements (the ones giving negligible response) may be further isolated from the ambient environment A and the ink environment I. For example such two less-responsive elements may be located in the thin film layer 44 in an area aligned with the substrate and the orifice layer where strains are negligible, but optionally are not even required to be located within thin film layer 44.

Referring to FIG. 6, another embodiment of a portion 70' of printhead 40 is shown in a region of pressure sensor 22. This embodiment is similar to that of FIG. 5 with like parts having like numbers. Note that in the FIG. 6 embodiment a separate ink detection slot 74 is etched or otherwise formed in the substrate. Such slot 74 need not be in communication with the slot 48, but does receive ink. As a result, the sensor 22 detects a pressure differential between the ambient pressure and the pressure in the detection slot 74. Such pressure in the slot 74 is generally the same as the pressure in the ink feed slot 48. Accordingly, backpressure is sensed. This embodiment allows sensor 72 to be located away from ink feed slot 48. By locating the sensor 72 away from the ink feed slot 48, less noise is detected by sensor 22 from the transient pressure changes of nozzle firing.

Figure 7:
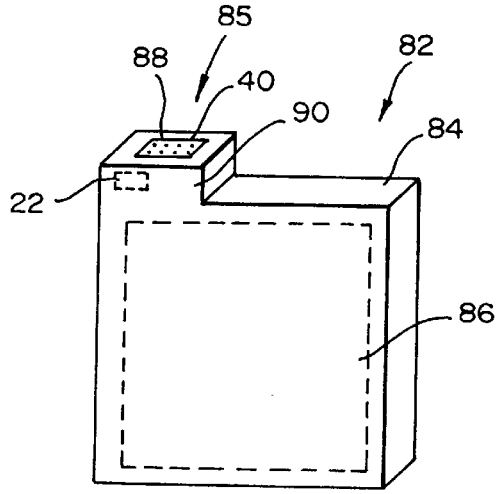
FIG. 7 is a perspective view of an inkjet printing apparatus with the printhead die of FIG. 3.

Referring to FIG. 7, an embodiment of the inkjet printing apparatus 10 includes an inkjet pen 82 formed by a pen body 84 to which is mounted an inkjet printhead 85. The pen body includes an internal ink reservoir 86 that stores ink. The printhead is formed by a printhead die 40 having an array of nozzles 88. In various embodiments the printhead die 40 includes a portion 70,70'. Ink is communicated from the reservoir 86 to the printhead nozzles through a fluid communication interface which encompasses a portion 90 of the pen body, and a portion of the printhead die 40 (e.g., slot 48 and feed channels 59). Preferably the pressure sensor 22 is formed integral to the printhead die 40. In some embodiments however the pressure sensor is mounted, or otherwise attached or integrated to the pen body adjacent to both an area susceptible to ambient air pressure and to ink backpressure.

Recirculating Ink Pen Embodiment

Figure 8:
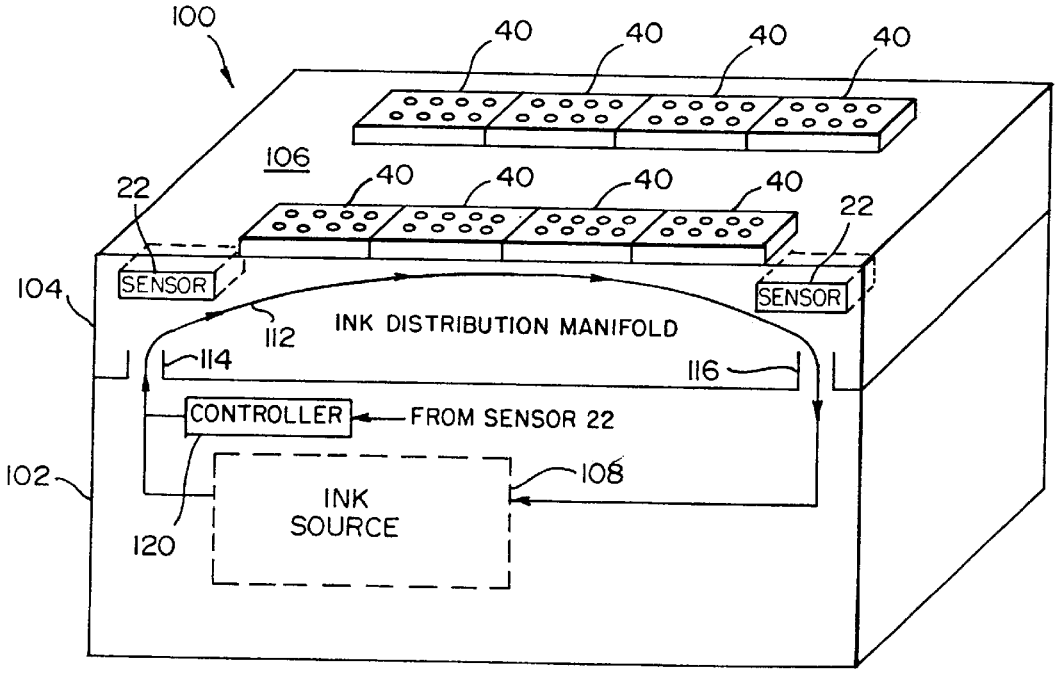
FIG. 8 is a perspective view of an inkjet printing apparatus having an elongated printhead including a plurality of printhead dies.

Referring to FIG. 8, an array inkjet pen 100 includes a pen body 102, an ink distribution manifold 104 and a printhead 106. Although the recirculating ink pen 100 is depicted as a wide array inkjet pen, in other embodiments the recirculating inkjet pen includes a smaller array printhead or a single head printhead.

The pen body 102 includes an ink source 108 and in some embodiments is coupled to receive ink additionally, or instead, from an external ink source apart from the pen body 102. The ink distribution manifold 104 receives ink from the ink source at an inlet 114, distributes the ink along a pathway 112 which ends at an outlet 116 recirculating the ink back to the in source 108. The printhead 106 includes a plurality of printhead dies 40. Each printhead die 40 includes an array of nozzles, an ink slot 48, feed channels 59 an ink chamber 56, a firing element 58 and a nozzle opening 54 as shown in FIG. 4.

The pen 100 also includes one or more pressure sensors 22. In some embodiments there is a pressure sensor integral to one or more printhead dies 40 such as described above with regard to the alternative embodiments of FIGS. 5–8. In some embodiments every printhead die 40 includes such as sensor 22. In an alternative embodiment there is a pressure sensor 22 mounted or otherwise attached or integrated into the ink distribution manifold 104. In various embodiments there is a pressure sensor 22 located in the vicinity of each of the inlet 114 and outlet 116. Alternatively there is a pressure sensor located in the vicinity of a first die along the recirculating path 112 and a last die along the recirculating path. Alternatively, one or more pressure sensors are situated in other locations adapted to detect backpressure.

In one application of the backpressure sensor, the backpressure sensor 22 output is fed to a controller 120, which controls the rate of flow of ink through the manifold 104 along the pathway 112. For example, when a pen 100 is being worked at a high load, it may be desirable to increase the flow rate to cool the printhead 106. As the flow rate is increased and decreased, drooling or depriming may occur, respectively due to pressure drop changes from inlet to outlet. In another application, the backpressure sensor reading is used by the controller 120 to assure that the flow rate is sufficient to maintain the backpressure at a desired level.

Meritorious and Advantageous Effects

One advantage of monitoring backpressure is to provide an indication of the operation of a printhead. This is beneficial for example in a pen having recirculating ink. The backpressure serves as a feedback for adjusting ink flow rate for a given work load of ink ejection. For example, when ink recirculation is increased and decreased to provide a cooling effect on the printhead, the pressure drop from inlet to outlet of the pen changes. Backpressure provides an indication of the change in the pressure drop.

Although a preferred embodiment of the invention has been illustrated and described, various alternatives, modifications and equivalents may be used. For example, although a wheatstone bridge circuit is described in a sensor embodiment for measuring variation of a piezoresistor under strain, in an alternative embodiment voltage can be measured directly across a piezoresistor under strain. Therefore, the foregoing description should not be taken as limiting the scope of the inventions which are defined by the appended claims.

What is claimed is:

1. An inkjet printing apparatus, comprising:

a pen body having an area for holding ink;

an inkjet printhead comprising an array of inkjet nozzles;

a fluid communication structure for transmitting the ink from the pen body into the array of nozzles, wherein a backpressure occurs within the fluid communication structure; and a pressure sensor for measuring the backpressure.

2. The apparatus of claim 1, wherein the pressure sensor is permanently attached to the pen body and is susceptible to pressure from ink flowing within the fluid communication structure.

3. The apparatus of claim 1, wherein the fluid communication structure comprises an ink distribution manifold, wherein the pressure sensor is formed integral to the ink distribution manifold.

4. The apparatus of claim 1, wherein the printhead comprises a die, the printhead die comprising the array of inkjet nozzles, an ink feed slot and a plurality of ink feed channels leading to the array of inkjet nozzles, wherein the fluid communication structure includes the ink feed slot and the ink feed channels.

5. The apparatus of claim 4, wherein the pressure sensor is formed integral to the printhead die.

6. The apparatus of claim 5, wherein the pressure sensor is susceptible to pressure from ink within the ink feed slot.

7. The apparatus of claim 5, wherein the printhead die further comprises an ink detection slot, the pressure sensor being susceptible to pressure from ink within the ink detection slot.

8. The apparatus of claim 1, wherein the printhead comprises a printhead die, the printhead die comprising a substrate, a thin film layer and an orifice layer, wherein the array of nozzles are formed in the thin film layer and the orifice layer, each nozzle of the array of nozzles comprising a nozzle chamber bounded by the thin film layer and orifice layer, a nozzle opening through the orifice layer, and a firing element situated within the thin film layer, the printhead die further comprising an ink feed slot and a plurality of ink feed channels coupling the ink feed slot to the array of nozzles, wherein the pressure sensor is formed integral to the thin film layer.

9. The apparatus of claim 8, wherein the printhead die further comprises an ambient opening distinct from the orifice openings which exposes a first portion of the thin film layer to ambient pressure, the pressure sensor being situated at least in part within said first portion of the thin film layer.

10. The apparatus of claim 9, wherein the pressure sensor is susceptible to pressure within the ink feed slot for detecting a pressure differential between pressure in the ink feed slot and the ambient pressure.

11. The apparatus of claim 9, wherein the pressure sensor is susceptible to pressure within a first ink feed channel of the plurality of ink feed channels for detecting a pressure differential between pressure in said first ink feed channel and the ambient pressure.

12. The apparatus of claim 9, wherein the pressure sensor is susceptible to pressure within a first nozzle chamber for the array of nozzles for detecting a pressure differential between pressure in the first nozzle chamber and the ambient pressure.

13. The apparatus of claim 9, wherein the printhead die further comprises an ink detection slot, the pressure sensor being susceptible to pressure from ink within the ink detection slot for detecting a pressure differential between the pressure in the ink detection slot and the ambient pressure.

14. The apparatus of claim 1, wherein the printhead comprises a printhead die, the printhead die comprising an ink distribution manifold and the array of inkjet nozzles, the manifold distributing ink into the array of inkjet nozzles, the fluid communications structure comprising the ink distribution manifold, wherein the pressure sensor is formed integral to the ink distribution manifold.

15. The apparatus of claim 1, wherein the printhead comprises a plurality of printhead dies, each one die of the plurality of printhead dies comprising a plurality of inkjet nozzles, wherein the fluid communication structure defines a recirculating ink flow path feeding ink to the plurality of printhead dies, the recirculating ink flow path having a first area through which ink flow toward the plurality of printhead dies and having a second area through which ink flows away from the plurality of printhead dies, wherein the pressure sensor is situated in a vicinity of either one or both of the first area and the second area.

16. The apparatus of claim 15, in which the pressure sensor is formed integral to the fluid communication structure.

17. An inkjet printhead comprising:

a substrate;

a thin film layer applied to the substrate;

an orifice layer applied to the thin film layer opposite the substrate; and a pressure sensor situated within the thin film layer, wherein an array of nozzles are formed in the thin film layer and the orifice layer, each nozzle of the array of nozzles comprising a nozzle chamber bounded by the thin film layer and orifice layer, a nozzle opening through the orifice layer, and a firing element situated within the thin film layer, the printhead further comprising an ink feed slot and a plurality of ink feed channels coupling the ink feed slot to the array of nozzle.

18. The printhead of claim 17, wherein the printhead further comprises an ambient opening distinct from the orifice openings which exposes a first portion of the thin film layer to ambient pressure, the pressure sensor being situated at least in part within said first portion of the thin film layer.

19. The printhead of claim 18, wherein the pressure sensor is susceptible to pressure within the ink feed slot for detecting a pressure differential between pressure in the ink feed slot and the ambient pressure.

20. The printhead of claim 18, wherein the pressure sensor is susceptible to pressure within a first ink feed channel of the plurality of ink feed channels for detecting a pressure differential between pressure in said first ink feed channel and the ambient pressure.

21. The printhead of claim 18, wherein the pressure sensor is susceptible to pressure within a first nozzle chamber of the array of nozzles for detecting a pressure differential between pressure in the first nozzle chamber and the ambient pressure.

22. The printhead of claim 18, wherein the printhead die further comprises an ink detection slot, the pressure sensor being susceptible to pressure from ink within the ink detection slot for detecting a pressure differential between the pressure in the ink detection slot and the ambient pressure.

23. A method for controlling ink flow to a plurality of nozzles along a recirculating ink flow path, the method comprising the steps of:

flowing ink along the recirculating ink flow path to feed ink to the array of nozzles;

sensing backpressure;

adjusting the flow of ink along the recirculating ink flow path in response to the sensed backpressure; and firing a plurality of the inkjet nozzles among the array of inkjet nozzles.

* * * * *